United States Patent [19]

Hawkins

[11] 4,314,719

[45] Feb. 9, 1982

[54] SLIDING PANEL LATCHING MECHANISM

[76] Inventor: Donald Hawkins, P.O. Box 1203, Tracy, Calif. 95376

[21] Appl. No.: 120,777

[22] Filed: Feb. 12, 1980

[51] Int. Cl.[3] ..... E05C 19/00; E05C 1/04

[52] U.S. Cl. ..... 292/252; 49/450; 292/145; 292/189; 292/302; 292/DIG. 46

[58] Field of Search ..... 292/252, 183, 184, 189, 292/145, 261, 299, 300, 302, DIG. 46; 49/449, 450, 451

[56] References Cited

U.S. PATENT DOCUMENTS

| | | | |
|---|---|---|---|
| 254,510 | 3/1882 | Slater | 292/252 |
| 948,598 | 2/1910 | Stuart | 292/252 |
| 3,014,745 | 12/1961 | Kytta | 292/252 |
| 3,415,560 | 12/1968 | Hawkins | 292/252 |
| 3,674,297 | 7/1972 | Hawkins | 292/252 |
| 4,190,271 | 2/1980 | Hawkins | 292/DIG. 46 X |

*Primary Examiner*—William E. Lyddane

*Attorney, Agent, or Firm*—Harris Zimmerman; Howard Cohen

[57] ABSTRACT

A latch mechanism for limiting the translation of a panel unit slidably secured in a track member includes a slide member secured in the track and adapted to translate therealong. The slide member includes an aperture in the bottom portion thereof which is registrable with any one of a plurality of depressions formed in the bottom of the track member. The slide member includes a pair of opposed, upwardly extending end tabs which retain a latch member therebetween. The latch member includes an aperture registrable with the aperture of the slide member, and is translatable transversely with respect to the track. A ball is disposed between the latch member and the slide member, and is adapted to fall gravitally into the aperture of the slide member and seat in a depression in the track. With the latch aperture aligned with the ball and slide aperture, the slide member may be translated along the track by unseating the ball from the track aperture. With the latch member translated so that the apertures do not align, there is not sufficient clearance for the ball to unseat from the depression it occupies and the slide member cannot be translated.

9 Claims, 6 Drawing Figures

SLIDING PANEL LATCHING MECHANISM

BACKGROUND OF THE INVENTION

The following United States Patents represent the closest known prior art:

U.S. Pat. No. 1,408,637
U.S. Pat. No. 2,029,016
U.S. Pat. No. 2,070,149
U.S. Pat. No. 2,699,204
U.S. Pat. No. 3,085,300
U.S. Pat. No. 3,124,380
U.S. Pat. No. 3,415,560

In the field of construction of dwellings, commercial buildings, and similar structures, there has been a great increase in recent years in the use of windows and vents which employ sliding panels. These windows and vents usually include a lower channel member having at least one track therein to receive a window or vent panel and permit it to be slidably and horizontally translated. Often these units are preassembled by original equipment manufacturers, and the prefabricated units are then installed with a minimum of labor in wall openings which are dimensioned to receive the units.

Although sliding panel, vent, and window units cannot be blown open by the wind, they are quite suseptible to being opened in an unconventional manner by vandals and thieves. To remedy this situation, there have been devised in the prior art many forms of locks to seal the units and prevent unauthorized entry therethrough. Other lock devices limit the opening afforded by the vent or window to prevent entry therein. In general, these lock devices are an added expense for each window, an expense which is greatly multiplied in a structure having many windows. Also, many of the lock units which require the proper keys for opening are a safety hazard in an emergency, in that they do not permit egress without the use of the proper key. During fires or similar emergencies, the time wasted unlocking a key-locked sliding window may determine the difference between escape and injury or death.

Also known in the prior art are devices which obstruct the track of a channel member to limit the opening of the sliding panel. These devices generally are provided to permit ventilation through a small opening in the sliding panel unit, the opening being insufficient to permit entry therethrough.

The references cited above generally disclose latch mechanisms for windows and sliding panel units, the latch mechanism employing a ball spring-biased into a detent hole. This principle of operation of a latch mechanism is unlike the functioning of the present invention, as are the structures disclosed in the prior art.

SUMMARY OF THE PRESENT INVENTION

The present invention generally comprises a latch mechanism for use in conjunction with a sliding panel vent or window unit. The latch mechanism is disposed in the track in which the sliding panel member translates, and is adapted selectively to limit the translation of the sliding panel member. The latch mechanism is particularly characterized by its use of a gravitally actuated ball detent mechanism which is highly resistant to being forced or jimmied, yet which requires little force to actuate and translate properly.

The latch mechanism includes a slide member received permanently and translatably in the track in which the sliding panel member is received for translation therealong. The slide member includes a lateral web portion which conforms substantially to the cross-sectional nature of the bottom of the track. A pair of tab members extend upwardly from longitudinally opposed ends of the web portion, the tab members serving to impinge upon the sliding panel member. The web portion of the slide member also includes a medially disposed circular aperture extending generally vertically therethrough. The bottom surface of the track includes a plurality of depressions formed therein and spaced therealong, any one of the depressions being registrable with the aperture in the slide member by selective translation of the slide member along the track.

The latch mechanism also includes a latch member which is received between the tab portions of the slide member and which is adapted to translate therewith along the track. The latch member includes a laterally extending panel which is spaced above the web portion of the slide member, and which also includes a circular aperture disposed medially therein and extending vertically therethrough. The latch member aperture is slightly smaller than the slide member aperture. A ball is disposed between the lateral panel of the latch member and the web portion of the slide member. The ball is slightly smaller in diameter than the aperture of the slide member, and slightly larger in diameter than the aperture of the latch member.

The lateral panel of the latch member is retained in the track, and is adapted for limited translation transverse to the extent of the track and within the confines of the tab members. More specifically, the latch member translates transversely to move the circular aperture therein into and out of registration with the circular aperture of the slide member therebelow.

Whenever the slide member is disposed with its aperture in registration with one of the depressions of the track, the ball will fall gravitally so that a portion of the ball will extend through the aperture of the slide member and seat in the depression. Thereafter, initiation of translation of the slide member along the track will cause the ball to unseat from the depression in the track by translating upwardly to clear the depression. However, the spacing of the lateral panel above the web portion does not provide sufficient clearance for the ball to move upwardly to the degree necessary to clear the depression in the track. Thus the latch member can prevent unseating of the ball in the depression in the track. Since the ball cannot disengage the depression, the slide member is latched thereby in that location in the track.

However, the latch member is transversely translatable to bring the circular aperture therein into registration with the ball and the circular aperture of the slide member. When these three things are in registration, the ball is provided with sufficient clearance in the circular aperture of the latch member so that it may unseat from the track depression and disengage therefrom. Thus when the apertures of the latch member and slide member are aligned, the latch mechanism may translate freely along the track; although the ball will continue gravitally to fall into the depressions in the track encountered therealong, only a very small amount of translational force applied to the slide member is required to unseat the ball when clearance is provided by the latch member aperture.

The latch member may be provided with an upwardly extending tab or handle to facilitate transverse translation thereof. Furthermore, the latch mechanism may be provided with spring means to bias the latch member toward a position of non-alignment of the respective apertures. Thus the latch mechanism would be biased to engage in and latch to any track depression encountered, unless manual force is applied to overcome the spring means.

A BRIEF DESCRIPTION OF THE DRAWING

DESCRIPTION OF THE PREFERRED EMBODIMENT

Figure 1:
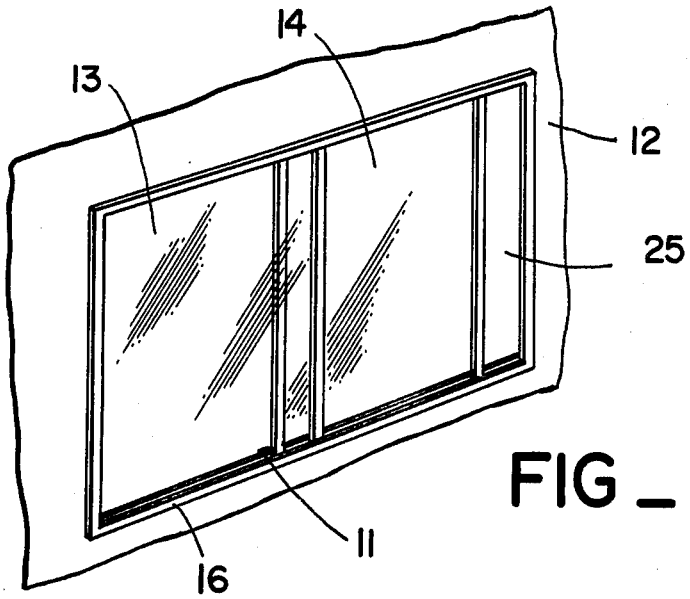
FIG. 1 is a perspective view of a sliding panel window unit employing the latch mechanism of the present invention.

With reference to FIG. 1, the present invention generally comprises a latch mechanism 11 which is employed in conjunction with a sliding panel vent or window unit 12. The unit 12 generally includes a pair of panels 13 or 14, with at least one of the panels being slidably and translatably disposed in a track portion of a channel member 16. The latch mechanism 11 is secured in the track portion of the channel member 16, and is adapted to limit adjustably and selectively the translational opening of the sliding panel unit.

Figure 3:
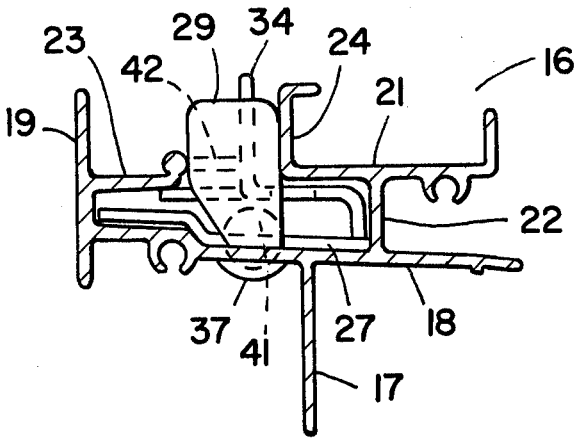
FIG. 3 is a cross-sectional view of the latch mechanism shown in the latched position in the track of a sliding panel unit.
Figure 4:
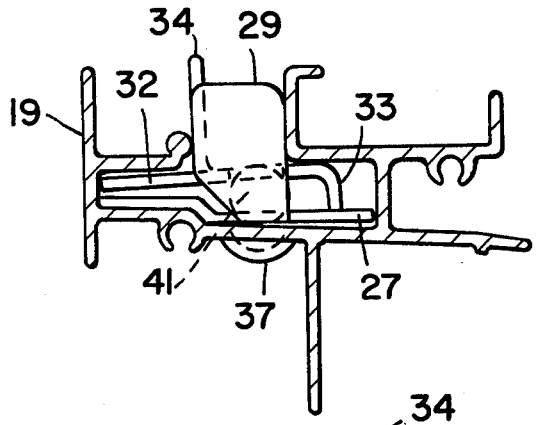
FIG. 4 is a cross-sectional view of the present invention as in FIG. 3, shown, however, in the unlatched position.
Figure 2:
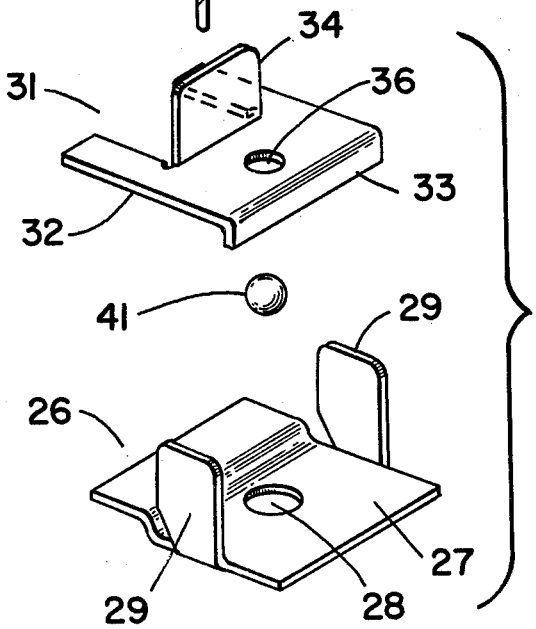
FIG. 2 is an exploded view of the parts forming the latch mechanism of the present invention.

One possible embodiment of the channel member 16 is shown in cross-section in FIGS. 3 and 4. It includes a vertical web member 17 which intersects a channel based panel 18 in T fashion. Joined to the interior edge of the base panel 18 is a longitudinally extending, vertically disposed sill 19. A generally T-shaped outer track member 21 extends longitudinally along the base panel 18, with the vertical web 22 of the track 21 secured superjacently to the base panel and offset outwardly from the vertical web portion 17. Generally speaking, the track 21 is provided to receive and support a fixed (i.e., non-translatable) panel member.

Extending inwardly from the sill 19 toward the track 21 is a longitudinally extending, horizontally disposed flange 23. It may be noted that the opposed, spaced apart portions of the flange 23 and the base panel 18, as well as the opposed confronting portions of the sill 19 and the web 22 define a longitudinally extending cavity in the channel member 16. Furthermore, the confronting edge portions of the flange 23 and the internal wall 24 of the track 21 define an upwardly opening slot which extends longitudinally in the channel 16. This slot and the cavity therebelow comprise a slot in which a panel member is received in sliding, translating fashion. The sliding panel 14, shown in FIGS. 1, 5, and 6, is translatable along the track just described to control selectively the opening 25 of the sliding panel unit 12.

With reference to FIGS. 1–4, the latch mechanism 11 includes a slide member 26 which is received in the track cavity. The slide member 26 includes a laterally extending web portion 27 which is slightly less in width than the distance between the sill 19 and the web 22 of the channel member 16. The web portion 27 is similar in vertical cross-sectional configuration to the configuration of the portion of the base panel 18 extending between the members 19 and 22. The web portion 27 includes a circular aperture 28 extending vertically therethrough and disposed medially in the web portion. The slide member 26 also includes a pair of tab members 29 disposed at longitudinally opposite ends of the web portion 27 and extending upwardly therefrom. The tab members 29 extend upwardly through the slot opening of the track in which the sliding panel resides.

Figure 5:
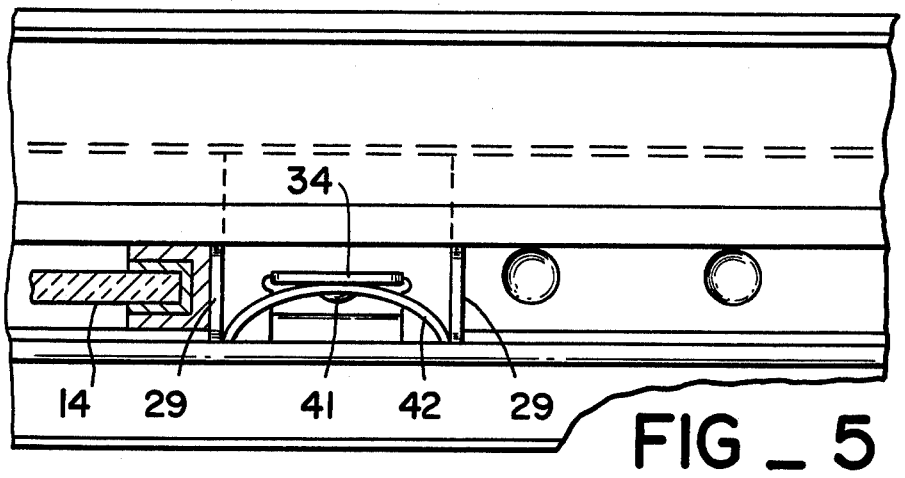
FIG. 5 is a plan view of the latch mechanism in the latched position in the track of a sliding panel unit.
Figure 6:
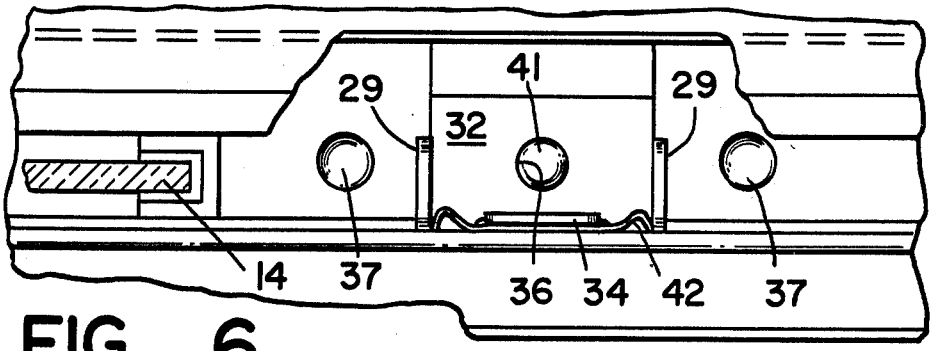
FIG. 6 is a plan view as in FIG. 5, with the latch mechanism shown in the unlatched position.

The latch mechanism 11 also includes a latch member 31 which is disposed directly above the slide member 26 and situated between the tab members 29 thereof, as shown in FIGS. 5 and 6. The latch member 31 includes a laterally extending panel 32 having a downwardly extending flange 33 disposed along one longitudinal edge thereof. A tabular handle member 34 is die cut from the panel 32 and bent upwardly generally orthogonally with respect to the lateral panel 32 and also with respect to the tab members 29 of the slide member 26. The lateral panel 32 also includes a circular aperture 36 disposed adjacent to the flange 33 and situated medially with respect to the longitudinal extent of the panel 32. The circular aperture 36 is slightly smaller in diameter than the circular aperture 28 of slide member 26.

With reference to FIGS. 3 and 4, both of the latch mechanism members 26 and 31 are retained in the track cavity by virtue of their lateral extent being greater than the width of the slot opening of the track. The downwardly extending flange 33 of the latch member 31 determines that the lateral panel 32 is spaced apart and above the web portion 27 of the slide member 26. The lateral panel 32 is less in width than the track cavity, and it is therefore translatable to a small degree in the direction transverse to the longitudinal extent of the track.

It may be noted that the track is provided with a plurality of detent depressions 37 formed in the base panel 18 of the channel member 16 and disposed directly below the slot opening of the track in which the sliding panel is situated. As shown in FIGS. 5 and 6, the detent depressions 37 may be spaced longitudinally along the base panel 18 of the channel member.

The latch mechanism 11 also includes a ball 41 which is spherical in configuration, smaller in diameter than the diameter of the aperture 28, and slightly larger in diameter than the diameter of the aperture 36 in the latch member 31. With reference to FIGS. 3 and 4, the ball 41 is disposed between the web portion 27 of the slide member and the lateral panel 32 of the latch member. The ball 41 is retained by the aperture 28 of the slide member, and is prevented from being unseated therefrom by the limited clearance of the lateral panel 32 thereabove.

It should be noted that the aperture 28 of the slide member is located so as to be registrable with any one of the detent depressions 37 in the track base panel 18, the aperture 28 being registrable with selective ones of the depressions 37 by translation of the latch mechanism along the track. Whenever the latch mechanism is translated to bring the aperture 28 into registration with one of the detent depressions 37, the ball 41 falls gravitally through the aperture 28 and seats in the respective detent depression 37. To cause further translation of the latch mechanism, a slight longitudinal force applied to one of the tab members 29 will cause the ball 41 to unseat from and clear the detent depression 37 in which it resides by moving vertically upwardly a distance sufficient to clear the depression. However, the lateral panel 32 of the latch member 31 does not provide sufficient vertical clearance to permit the ball 41 to rise vertically and to clear the detent depression 37 in which it is seated. In this disposition, shown in FIGS. 3 and 5, the latch mechanism is immobilized in its location in the track, due to the fact that the ball 41 cannot unseat from the detent depression 37.

To permit movement of the latch mechanism along the track, the latch member 31 may be translated in a direction transverse to the track, so that the aperture 36 is brought into alignment with the aperture 28 and the ball 41. In this disposition, shown in FIGS. 4 and 6, the aperture 36 provides the vertical clearance for the ball 41 to rise vertically a sufficient distance to clear the detent depression 37. In this unlatched configuration, the latch mechanism 11 may be translated freely along the track. Although the ball 41 will fall gravitally into each depression 37 encountered along the track, it will unseat from each depression quite easily and will provide no impediment to translation of the latch mechanism along the track.

It may be appreciated that the latch mechanism 11 may be translated along the track by placing the latch member 31 in the position shown in FIGS. 4 and 6, and thereafter applying longitudinal force to one of the tab members 29. The latch mechanism will be brought into alignment with any of the detent depressions 37, and the ball 41 will seat gravitally therein. To immobilize the latch mechanism at the location of any of the detent depressions 37, it is necessary merely to translate the latch member 31 transversely so that the aperture 36 is not aligned with the ball 41 and the aperture 28, as shown in FIGS. 3 and 5. Thus the latch mechanism 11 may be locked in any one of a plurality of positions along the track, the latch mechanism serving to block the translational opening of the sliding panel which is received in the track.

In a further embodiment of the present invention, a leave spring 42 may be secured between the tab members 29 and disposed to impinge upon the handle 34 of the latch member 31. The leaf spring 42 is provided to bias resiliently the latch member 31 toward the latch (locked) position shown in FIGS. 3 and 5. The spring 42 thus would cause the latch mechanism to lock at the location of any detent depression 37, unless manual force is applied to the handle 34 to overcome the spring force and release the latch mechanism from the detent depression therebelow.

It may be appreciated that the latch mechanism may be secured in the track prior to final assembly of the sliding panel unit 12, and is adapted to operate equally well in left-hand or right-hand opening units. Furthermore, once the unit is assembled, the latch mechanism is permanently secured in the track and cannot be removed accidentally or purposely. The latch mechanism cannot be disassembled, and the ball cannot fall out of or be removed from the latch mechanism, either during shipment of the unit or during and after installation of the unit.

I claim:

1. In a channel-like track construction for receiving a sliding member, a latch assembly for releasably locking in said track and preventing translation of said sliding member thereby, said latch assembly including one or more detent depressions spaced longitudinally along and formed in the base panel of said track; a slide member secured in said track and adapted for longitudinal translation therealong, said slide member including a first aperture extending vertically therethrough and registerable with any one of said detent depressions; a ball seated in said aperture and adapted to fall gravitally therethrough into any of said detents; a latch member including a second aperture extending vertically therethrough, said second aperture being smaller in diameter than said ball; first means for joining said latch member to said slide member for longitudinal translation therewith, said latch member being translatable with respect to said slide member transverse to said track to move said second aperture into and out of alignment with said first aperture; second means for spacing said latch member above said slide member to retain said ball therebetween, said latch member and slide member being spaced apart a distance less than the diameter of said ball.

2. The latch assembly of claim 1, wherein said slide member includes a web member extending parallel to and impinging on said base panel of said track.

3. The latch assembly of claim 2, wherein said first means includes a pair of tab members extending upwardly from longitudinally opposed ends of said web member, said latch member being retained between said tab members.

4. The latch assembly of claim 1, wherein said latch member includes a laterally extending panel through which said second aperture extends.

5. The latch assembly of claim 4, wherein said second means includes a flange disposed along one longitudinal edge of said laterally extending panel and extending downwardly to impinge on slide member.

6. The latch assembly of claim 1, further including a handle member extending upwardly from said latch member to facilitate transverse translation thereof.

7. The latch assembly of claim 1, further including spring means for biasing said latch member transversely to misalign said first and second apertures.

8. The latch assembly of claim 7, wherein said spring means includes a leaf spring secured to said slide member and impinging on said latch member.

9. The latch assembly of claim 1, wherein said latch assembly is slidably and permanently secured in said channel member.

* * * * *